United States Patent [19]

Dubinin et al.

[11] 4,212,904

[45] Jul. 15, 1980

[54] METHOD FOR TREATING ITEMS FROM MAGNETICALLY SOFT ALLOYS

[76] Inventors: Georgy N. Dubinin, Lazovsky pereulok, 4, kv. 35; Vladimir F. Rybkin, Leninsky prospekt, 37a, kv. 208; Mira P. Petrova, I Zborovsky pereulok, 15, kv. 7; Elizaveta L. Avrukh, ulitsa Chusovskaya, 10, korpus 2, kv. 35; Viktor V. Khramtsov, Schelkovskoe shosse, 81, kv. 90; Alexandr D. Zhivotchenko, ulitsa Kosmodemianskikh, 34a, kv. 39, all of Moscow; Viktor F. Kuznetsov, ultisa Karpinskogo, 36, korpus 1, kv. 77, Leningrad, all of U.S.S.R.

[21] Appl. No.: 44,971

[22] Filed: Jun. 4, 1979

[51] Int. Cl.[2] ..... C23C 9/02

[52] U.S. Cl. ..... 427/127; 427/253; 148/122; 428/900; 427/374.1

[58] Field of Search ..... 427/127, 104, 253, 252, 427/374 R; 148/122, 100, 31.55; 360/122; 428/900

[56] References Cited

U.S. PATENT DOCUMENTS 4,130,847 12/1978 Head et al. ..... 360/122

FOREIGN PATENT DOCUMENTS 1147586 6/1957 France .

50-04463 2/1975 Japan .

*Primary Examiner*—Ralph S. Kendall

*Attorney, Agent, or Firm*—Haseltine, Lake & Waters

[57] ABSTRACT

A method according to the present invention is intended for treating items (articles) for magnetically soft alloys employed in radio-electronic, relay and switching apparatus, in optical-and-mechanical and automation systems. The method consists in saturating the surface of items with chromium inside a powder chromizing mixture at a temperature in excess of 800° C. The items are heated at a rate not higher than that of recrystallization of a metal of the items, and the rate of diffusion processes of saturating the items. The items are cooled at a rate close to that of phase transformations and formation of a magnetic structure in the metal of the items, for example, at the rate of 20-200 degree/hour below the Curie point. To enhance the magnetic properties and the stability thereof, as well as wearability and the resistance of the items to corrosion, chromizing of the item surfaces is conducted in an inert gas atmosphere.

4 Claims, 1 Drawing Figure

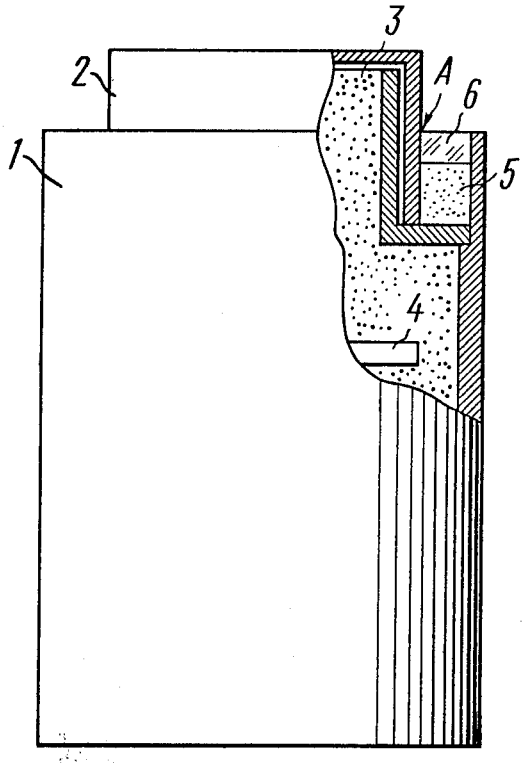
3
2
A
6
1
5
4

METHOD FOR TREATING ITEMS FROM MAGNETICALLY SOFT ALLOYS

BACKGROUND OF THE INVENTION

1. Field of the Invention

The invention relates to metallurgy and, more particularly, to a method for treating items from magnetically soft alloys.

The present invention can find a most effective application in manufacture of parts of radio-electronic, relay and switching apparatus of optical-and-mechanical and automation systems.

In addition, the present invention can be employed for manufacturing parts from magnetically soft alloys for computer, aircraft and space equipment.

2. Description of the Prior Art

Present-day instrument manufacture imposes strict requirements for physico-chemical properties of parts of magnetic systems from magnetically soft alloys. Thus, magnetically soft alloys are required to have high and stable magnetic properties along with a high electric resistivity; a high corrosion resistance in moist atmospheres, in marine climates, in industrial atmospheres in acid solutions and in fungous media and; in some applications, both high hardness of the surface and wearability thereof.

The existing magnetically soft alloys fail to meet the above set of conditions, thus lowering the reliability and durability of electromagnetic instruments and devices.

Such a variety of physico-chemical properties cannot be obtained by integral alloying, as acquisition of some properties is accompanied by a loss of others. Neither can this problem be solved by other currently available processing means, such as vacuum annealing (or annealing in an atmosphere of hydrogen, argon or dissociated ammonia) with subsequent application of chemical coats, galvanizing and electroplating of items from alloys based on iron, nickel and cobalt; nor by vacuum annealing or vacuum annealing with subsequent thermal oxidizing of items from iron-silicon and iron-nickel alloys.

The above kinds of annealing affect only the structurally sensitive magnetic properties (magnetic permeability, coercive force) and fail to provide the necessary set of physico-chemical properties, since, for example, annealing lowers resistance of parts to corrosion and their wearability.

Vacuum annealing with subsequent thermal oxidizing is effective with respect only to parts made of thin and extra thin rolled alloy products which can be provided with a protective oxide film inhibiting their further oxidation (for example, when processing parts of iron-silicon and iron-nickel alloys). Galvanizing, chemical coating and electrochemical plating employed subsequently to one of the kinds of annealing with a view to improving the corrosion and the wear resistance of parts fail in some instances to provide coats of required resistance to corrosion and wear, the coats possessing a poor continuity of deposited layers and poor adhesion strength, whereas high residual stresses in the coats cause their cracking and peeling in service. In addition, the above coats lower the structurally sensitive magnetic characteristics, stability of properties and substantially increase manufacturing cycle.

There is known a method for diffusion chromizing of structural steels and alloys, employed with a view to enhancing wearability and corrosion resistances, consisting in heating items in a powder mixture of chromium, aluminum oxide and ammonia, exposing the items to temperatures between 800° and 1200° C. for over an hour, followed by subsequent cooling thereof.

However, the known method for diffusion chromizing fails to improve the magnetic properties of magnetically soft alloys and stability thereof, since a necessary set of physico-chemical properties in parts from magnetically soft alloys is possible only at appropriate rates of heating and cooling, which are not provided for by the existing methods of diffusion chromizing.

There is known a method for diffusion chromizing of parts from permalloy, heated to 800° C. and above in an atmosphere of a chromium halide compound and gaseous hydrogen with subsequent cooling of items (Japan, patent application no. 45-123347, filed 31.XII.70).

However, notwithstanding, intricate processing requiring complicate and costly equipment, the above method fails to provide the necessary set of physico-chemical properties. For example, the method cannot provide a necessary wearability of parts subject to intensive deterioration, since it necessarily involves the use of a gaseous hydrogen atmosphere where items decarburize readily. This produces a solid solution of chromium in iron in the surface layers of the items, the wearability of which is rather poor. In addition, this method fails to ensure high corrosion resistance in chlorine ion media, as the thickness of the diffusion layer is small.

SUMMARY OF THE INVENTION

It is therefore an object of the invention to improve the magnetic characteristics of items from magnetically soft alloys and the stability thereof.

Another object of the invention is to enhance the corrosion resistance of parts from magnetically soft alloys.

Yet another object of the invention is to raise the wear-resistant properties of items from magnetically soft alloys.

It is also an object of the invention to reduce the processing cycle and to lower manpower requirements for treating items.

Still another object of the invention is to provide an adequate roughness of the surface of items.

In addition, an object of the invention is a reduction of the manufacturing cycle of parts from magnetically soft alloys.

A further object of the invention is to raise the reliability and durability of parts from magnetically soft alloys.

An additional object of the invention is an economy of production floorspace necessary for manufacturing items from magnetically soft alloys.

And finally, an object of the invention is to cut down the cost of manufacture of items from magnetically soft alloys.

The above and other objects are attained in a method for treating items from magnetically soft alloys, comprising saturating surfaces of items with chromium at a temperature between 800° and 1200° C. and subsequently cooling them. According to the invention, the items are heated in a powder chromizing mixture at a rate not higher than that of recrystallization of a metal of items and that of diffusion processes of saturation of the items, whereas the items are cooled at a rate close to that of phase transformations and formation of a magnetic structure in the metal of the items.

The present invention can improve the quality of the items from magnetically soft alloys through an appropriate choice of the rate of heating and that of cooling of items which correspond to the formation of a necessary structure and refining of the metal in the protective coat application process. This provides a basis for combining annealing of the items with the application thereon of a protective coat having a high chromium content (65 to 85% Cr). This appreciably reduces the processing cycle. The conditions chosen for diffusion chromizing substantially raise the magnetic permeability, lower the coercive force and the magnetic ageing of the items and enhance the corrosion resistance thereof under high moisture conditions, as in sea fogs, in tropics, in nitric acid solutions, in industrial atmospheres containing-sulfurous gas and in fungous media. The formation then on the surface of the items of a carbonitride phase $Me_2$ (N, C) lays the basis for a material increase in the wear-resistant properties of the surface of the items. The present invention provides excellent uniformity and low porosity of the protective coat, a negligible roughness of the surface; reduces the requirements in industrial floorspace and brings down the cost of manufacture of the items.

In addition, the present invention greatly improves the reliability and durability of electromagnetic apparatus and devices.

The present invention can find an effective use in the manufacture of electromagnetic relays, step-by-step electric motors, usual types of electric motors, switches, electromagnetic clutches, magnetic heads, screens and miscellaneous other items, both on small- or medium-lot and mass production scales.

It is advisable to effect the heating of the items at rates of 200–400 degree/hour.

The choice of this range of heating rates provides appropriate conditions for the formation of a necessary metallographic and crystallographic structure, a necessary depth of refining and for preparing a protective coat of good continuity and density of diffusion layer.

When the items are heated at a rate less than 200 degree/hour, on the one hand, the rate of dissociation of ammonia is inadequate, and the rate of oxygen removal from the reaction is low, so that the items are oxidized, and on the other hand, the starting concentrations of chromium in the containerreaction space are low. Therefore, when the items are heated at the rate of less than 200 degree/hour, the protective coat formed on the surface thereof is highly porous, the porosity of the diffusion layer increasing inversely to the rate of heating.

According to one of the embodiments of the invention, the items are cooled at the rate of 20–200 degrees/-hour below the Curie point (below the temperature of the magnetic structure formation) so as to avoid the appearance of high body stresses and of an internal work hardening in the core of the metal, and avoid also the precipitation of secondary phases when iron-nickel and iron-cobalt items are involved, and, therefore, to obtain high magnetic properties.

In another embodiment of the invention, it is advantageous to saturate items in an inert gas atmosphere.

The saturation of the surface of items in an inert gas atmosphere enchances the continuity of the diffusion layer and the corrosion resistance of items, wearability, magnetic properties and the stability thereof. This is due to the fact that items are not oxidized in an inert gas atmosphere at the initial stages of the process which otherwise is unavoidable.

BRIEF DESCRIPTION OF THE FIGURE

These and other objects and features of the invention become readily apparent from one embodiment thereof which will now be described by way of example with reference to the accompanying drawing, which is a partial sectional elevational view showing a container for carrying out the method according to the invention.

DESCRIPTION OF THE PREFERRED EMBODIMENT

A container 1 is made of steel and is a body with a mouth closed by a cover 2. The interior of the container 1 is filled with a chromizing mixture 3, wherein are placed items 4 to be treated. An annular space A between the body of the container 1 and the cover 2 is filled with a quartz sand 5. A layer of ground nitrosilicate glass 6 is placed thereon. The quartz sand 5 and the nitrosilicate glass 6 form a fusible seal of the container 1.

The treatment of parts from magnetically soft alloys includes the following steps:

1. Preparation of a chromizing mixture.

The chromizing mixture 3 contains chromium or ferrochrome, aluminum oxide (which can be substituted by quartz sand, kaolin, chromium oxide or magnesium oxide) and ammonia (chloride, iodide, bromide, fluoride). The mixture is prepared directly before use.

The prepared mixture is thoroughly mixed and calcinated in the container 1, at the temperature of 1050°–1100° C.

2. Preparation of the surface of the items 4. The surface of the items 4 to be chromized is chlorided, cleaned of traces of dirt, corrosion and scale.

3. Packing of the items 4 to be treated in the container 1. The items 4 are placed in the container 1 and interspersed with the chromizing mixture 3, so as to keep them clear of one another and of the walls of the container 1. Once the items are placed into the container 1, the cover 2 thereof is put into place, and the annular space A between the container 1 and the cover 2 is filled with the quartz sand 5 and the nitrosilicate glass 6, the container 1 is then placed inside a furnace.

4. Heating of the container 1 inside a furnace and chromizing of parts.

The container 1 with the items 4 can be heated in any thermal furnace with any kind of heating. The rate of heating of the container should range between 200° and 400° C./h.

A variation of the rate of heating of the container 1 in chromizing, ranging from 25 to 800 degree/hour, exerts no appreciable influence upon the magnetic properties of the alloys, except for the effect upon the magnetic properties of alloys based on nickel when these are heated at a rate over 400° C./h.

The adverse effect upon the magnetic properties of permalloy, for example, is explained by that the necessary rate of heating is governed by the rate of recrystallization of the alloy (the rate of recrystallization of the alloy is 400–500 degree/hour). The rate of heating of an item in chromizing has also a substantial influence upon the continuity of the diffusion layer. This is due to the effect the rate of heating has upon the rate of reactions and the diffusion processes inside the container 1.

On heating, the air is displaced from the container 1 by products of dissociated ammonia through the annular space A between the cover 2 and the container 1 until the nitrosilicate glass 6 melts. Next, the glass 6 melts and seals off the container 1.

When items are heated at a rate less than 200 degree/-hour, on the one hand, the ammonia dissociation rate is insufficient and the rate of removal of oxygen from the reaction space of the container is low, so that the items oxidize. On the other hand, when items are heated at a rate less than 200 degree/hour, the concentration of chromium is excessively low in the container reaction space, and, consequently, a protective coat formed on the surface of items is highly porous.

The porosity of the diffusion layer increases, as the rate of heating slows down.

The temperature and the chromizing time are governed by the required wearability, resistance to corrosion as well as by magnetic and electric properties. The chromizing time is counted from the moment the container 1 is heated to a specified temperature.

5. Cooling and unpacking the container 1.

Once chromizing has been completed, the container 1 is cooled at the rate of 20–300 degree/hour, i.e., at a rate close to that of the phase transformations and of formation of the magnetic structure in the metal of items, to a temperature below the Curie point. This avoids high body stresses in the metal of the items and of internal work hardening, and the precipitation of secondary phases if items from iron-nickel or iron-cobalt alloys are involved.

Upon cooling, the solidified glass 6 in the seal of the container 1 is to be broken, and the chromizing mixture sieved and poured into a box especially provided for the purpose of making the mixture reusable.

To enhance magnetic and corrosion-resistant properties, and the continuity and wearability of the diffusion layers, chromizing should best be conducted in an inert gas atmosphere (hydrogen, argon, dissociated ammonia, nitrogen-hydrogen mixture). As a result the items are not oxidized on the initial stages of the process, as is the case otherwise. This increases increasing the degree of refining of the metal of the item.

6. Cleaning chromized parts.

Once discharged from the container 1, the parts should be flushed with hot water.

The effect of the rates of heating and cooling of the items 4 upon their magnetic properties, as for example, items made from Armco iron and permalloy are listed in the Tables 1 and 2.

Table 1

| Rate of heating, degree/ /hour | Alloy | Magnetic permeability, Gs/Oe | Field intensity, Oe | Coercive force, Oe |
|---|---|---|---|---|
| 25 | Armco iron | 9100 | 84 | 61 |
| | Permalloy | 290,000 | 1.1 | 1.05 |
| 50 | Armco iron | 9350 | 80 | 58 |
| | Permalloy | 295,000 | 1.1 | 1.00 |
| 100 | Armco iron | 9270 | 85 | 59 |
| | Permalloy | 285,000 | 1.2 | 1.06 |
| 200 | Armco iron | 9330 | 80 | 56 |

Table 1-continued

| Rate of heating, degree/ /hour | Alloy | Magnetic permeability, Gs/Oe | Field intensity, Oe | Coercive force, Oe |
|---|---|---|---|---|
| | Permalloy | 293,600 | 0.90 | 1.01 |
| 400 | Armco iron | 9360 | 80 | 56 |
| | Permalloy | 281,000 | 1.00 | 1.05 |
| 800 | Armco iron | 9200 | 85 | 58 |
| | Permalloy | 85,000 | 1.81 | 1.25 |

Table 2

| Alloy | Cooling conditions | Magnetic permeability, Gs/Oe | Field intensity, Oe | Coercive force, Oe |
|---|---|---|---|---|
| | Diffusion chromizing by one of the known methods | | | |
| Armco iron | 50° C./h down to 600° C. and then in the air | 5360 | 120 | 78.0 |
| Armco iron | Cooling in the air from the isothermal temperature of the process | 7500 | 91 | 91 |
| Armco iron | Cooling together with the furnace | 9500 | 87 | 72 |
| | Diffusion chromizing by the method according to the invention | | | |
| Armco iron | Cooling together with the furnace to 700° C. and then in the air | 10,200 | 82 | 61 |
| Armco iron | Cooling together with the furnace to 600° C. and then in the air | 11,500 | 78 | 57 |
| | Knowm method | | | |
| Permalloy | Cooling in the air from the isothermal temperature of the process | 60,000 | 2.52 | 2.61 |
| Permalloy | Cooling together with the furnace | 225,000 | 0.95 | 0.91 |
| | Method according to the invention | | | |
| Permalloy | Cooling together with the furnace to 400° C. and then in the air | 270,000 | 0.82 | 0.87 |
| Permalloy | Cooling together with the furnace to 600° C. and then in the air | 324,400 | 0.805 | 0.841 |

As is readily apparent from Tables 1 and 2, the rates of heating and of cooling in diffusion chromizing have a substantial influence upon the magnetic properties of magnetically soft alloys.

What is claimed is:

1. A method for treating articles made from magnetically soft alloys, comprising the steps of: chromizing the surface of the articles inside a powder chromizing mixture at a temperature of 800°–1200° C. and cooling subsequently the articles at a rate not exceeding that of recrystallization of a metal of said articles and applying diffusion processes of saturation of said articles, said articles being cooled at a rate close to that of diffusion transformations and of formation of magnetic structure in metal of said articles.

2. A method as claimed in claim 1, wherein said articles are heated at a rate of 200–400 degree/hour.

3. A method as claimed in claim 1, wherein said articles are cooled at a rate of 20–200 degree/hour below the Curie point.

4. A method as claimed in claim 1, wherein said articles are chromized in an inert gas atmosphere.

* * * * *